US006073598A

United States Patent [19]

Trozzi

[11] Patent Number: 6,073,598

[45] Date of Patent: Jun. 13, 2000

[54] STARTING DEVICE FOR AN INTERNAL COMBUSTION ENGINE

[75] Inventor: Michele Trozzi, Pescara, Italy

[73] Assignee: Magneti Marelli Manufacturing S.p.A., Milan, Italy

[21] Appl. No.: 09/209,769

[22] Filed: Dec. 11, 1998

[30] Foreign Application Priority Data

Dec. 11, 1997 [IT] Italy ..... TO97A1076

[51] Int. Cl.[7] ..... F02N 11/02

[52] U.S. Cl. ..... 123/179.3; 123/179.25; 290/38 A

[58] Field of Search ..... 23/179.3, 179.25; 290/38 A, 38 R

[56] References Cited

U.S. PATENT DOCUMENTS 1,246,207 11/1917 Wilson ..... 290/38 A
5,383,428 1/1995 Fasola et al. ..... 123/179.3
5,505,169 4/1996 Mummert t al. ..... 123/179.3

FOREIGN PATENT DOCUMENTS 422088 1/1925 Germany .
4302143 7/1994 Germany .
136394 12/1919 United Kingdom .

*Primary Examiner*—Andrew M. Dolinar
*Attorney, Agent, or Firm*—Sughrue, Mion, Zinn, Macpeak & Seas, PLLC

[57] ABSTRACT

A starting device for an internal combustion engine is described comprising a rotating electric machine the rotor of which is axially translatable with respect to the stator between a rest position and a working position. The rotor is fixed to a transmission shaft bearing a pinion capable of engaging with a corresponding toothed ring of the internal combustion engine when the rotor is in the working position. The starting device is further provided with a controlled-conduction semiconductor device disposed in series with the windings of the stator and the rotor, and an electronic control circuit for the semiconductor device for controlling the intensity of the current supplied to the electric machine.

9 Claims, 4 Drawing Sheets

STARTING DEVICE FOR AN INTERNAL COMBUSTION ENGINE

BACKGROUND OF THE INVENTION

The present invention concerns a device for starting an internal combustion engine as defined in the preamble to the main claim.

Such devices conventionally include an electric machine associated with a transmission shaft provided with a toothed member, or pinion. During starting, the pinion is brought into engagement with a corresponding toothed member, or ring, of the internal combustion engine. On engagement, the torque generated by the electric machine is transferred to the shaft of the internal combustion engine.

Various arrangements are known in the art for the production of the simplest and least cumbersome starter motors possible.

In almost all cases, a specific two-phase operative arrangement is now preferred: a first phase in which the pinion is engaged with the toothed ring in order to couple the starter motor and the internal combustion engine; and a second phase in which the starter motor is supplied at full current and torque transfer takes place.

Arrangements are known in which the pinion is engaged with the ring before the electric machine is started, for example, by means of a lever controlled by the displacement of the movable core of an electromagnet disposed alongside the electric machine.

Arrangements are also known in which the coupling of the pinion with the ring occurs simultaneously with the starting of the electric machine and is, in fact, caused by the particular mode of operation of this latter.

In particular, an arrangement is known in which the rotor of the electric machine is disposed, at rest, partially offset in a longitudinal direction with respect to the stator.

The electric machine is so formed that, when it is energised, a magnetic attraction is generated between the stator and the rotor which causes the axial translation of this latter towards the stator. The translating rotor accompanies the pinion to engage the corresponding toothed ring.

During operation, the electrical supply to the electric machine is controlled by an electromagnetic switch.

During the first phase, the switch is arranged to supply a limited current to an auxiliary stator winding of the electric machine, sufficient to cause the attraction and translation of the rotor (together with a slow rotation), and the coupling of the pinion with the ring.

During the second phase, the switch supplies the principal stator winding of the electric machine with a high current in order to deliver a high torque.

A disadvantage with these arrangements is that they require the presence of an electromagnetic switch which is generally mounted such that it projects, thus increasing the bulk of the starter motor.

Further problems arise during the assembly of the entire device on the ring of the engine intended to receive it: the presence of the switch impedes the formation of a device having substantially axial symmetry, and restricts its spatial orientation. This gives rise to the necessity of producing different elements to support and fix the device depending on the particular engine for which it is intended, with a consequent unwanted increase in production time and costs.

A further disadvantage is the excessive complexity of known starter motors, both from the mechanical point of view, due to the presence of complicated kinematic mechanisms for the translation, engagement and disengagement of the pinion, and from the electrical point of view, as two distinct field windings are sometimes required for the stator.

SUMMARY OF THE INVENTION

The object of the invention is to overcome these disadvantages with a starting device for an internal combustion engine, the essential characteristics of which are defined in the characterisation part of the accompanying main claim.

The device according to the invention is of the known type described above in which the rotor of the electric machine is axially translatable with respect to the stator.

In this device, the electrical supply to the electric machine during the two operating phases occurs by way of a controlled-conduction semiconductor device controlled by an electronic control circuit, which provides for the supply of an electric current to the single stator winding that varies according to the operational phase.

BRIEF DESCRIPTION OF THE DRAWINGS

Further characteristics and advantages of the invention will become clear from the following detailed description of an embodiment, given purely by way of non-limitative example with reference to the accompanying drawings in which.

DETAILED DESCRIPTION OF THE INVENTION

Figure 1:
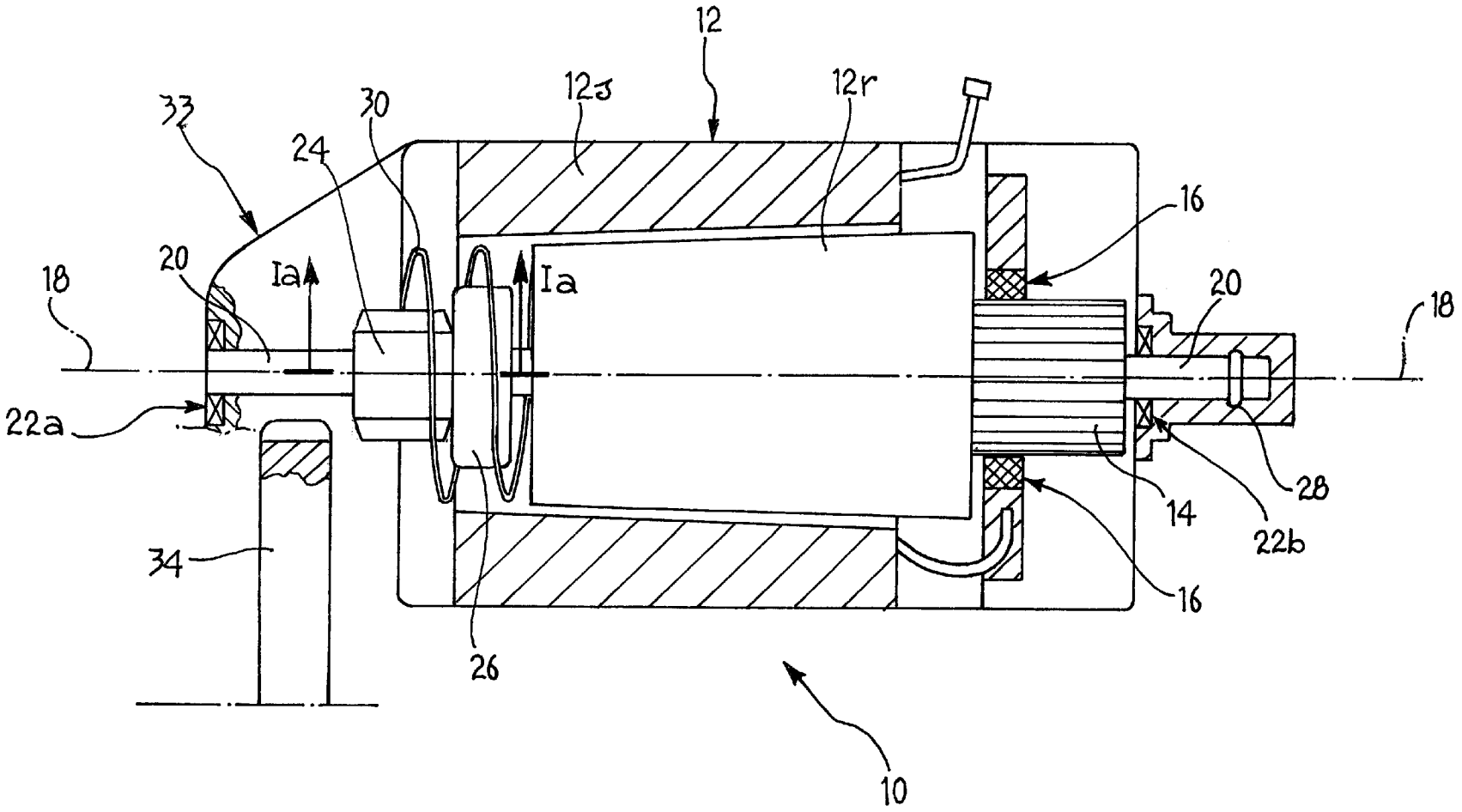
FIG. 1 is a schematic view in partial section of the device according to the invention in the rest position.
Figure 2:
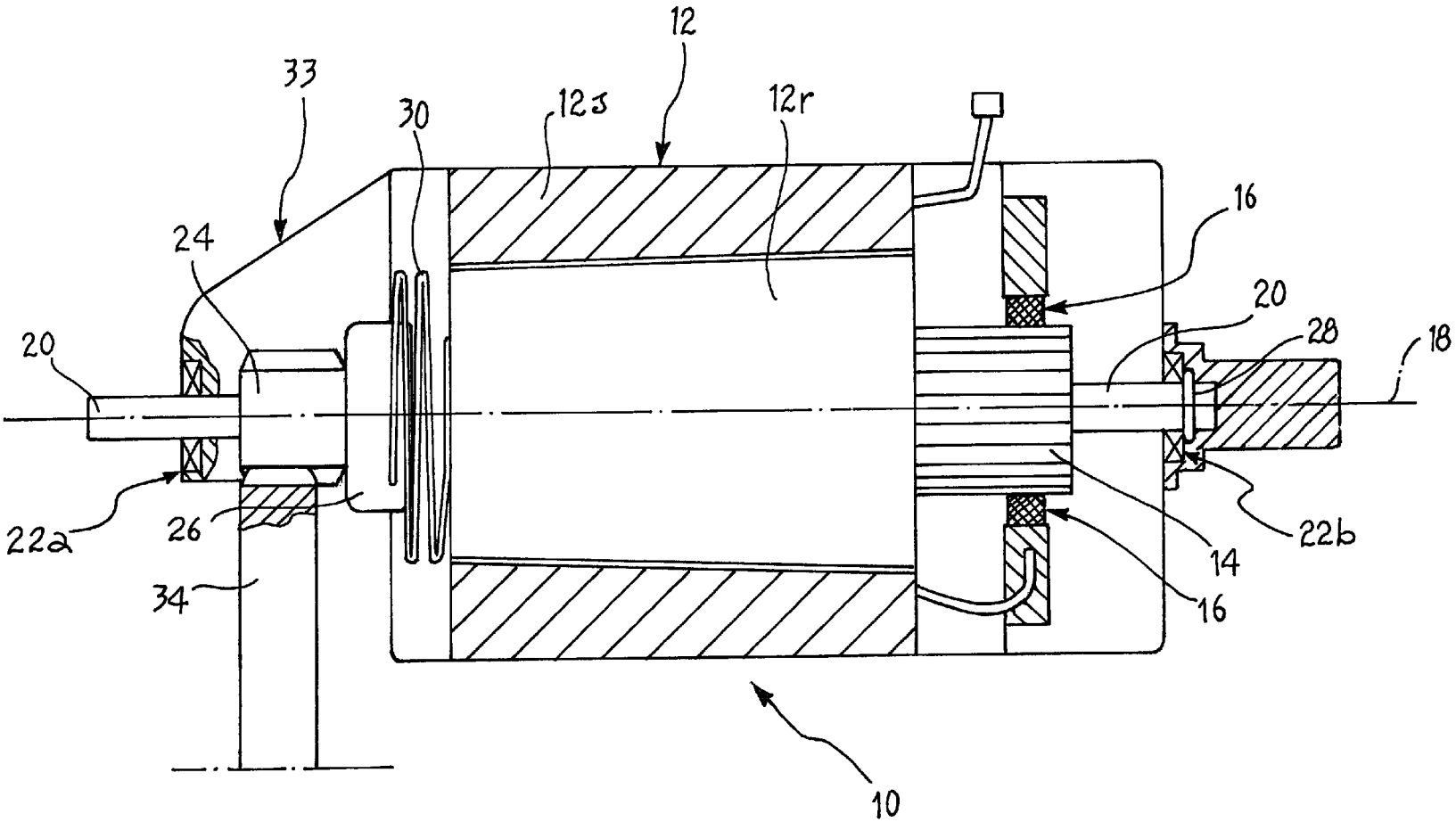
FIG. 2 is a schematic view in partial section of the device according to the invention in the working position.

FIGS. 1 and 2 show a starting device according to the invention, generally indicated 10, in a rest position and a working position respectively.

This device comprises an electric machine 12, the rotor 12*r*, the stator 12*s* (in section), the commutator 14 and the brushes 16 of which are schematically illustrated. The longitudinal axis of symmetry of the device is indicated 18.

In the rest position (see FIG. 1), the rotor 12*r* is axially offset with respect to the stator 12*s;* in the working position (see FIG. 2), the rotor 12*r* is on the other hand in a substantially centred position with respect to the stator 12*s*.

It is important that the corresponding rotor and stator profiles are shaped so as to generate a longitudinal component of the magnetic flux in the magnetic circuit of the electric machine.

In the particular embodiment described below, the rotor 12*r* has a frusto-conical shape with the major base facing towards the commutator, but other shapes are of course possible such as, for example, a shape with a stepped lateral face.

The commutator 14 of the electric machine, as clearly illustrated in the drawings, is axially elongate in shape in order to allow contact with the brushes 16 along the entire axial stroke of the rotor 12*r*.

The rotor 12*r* is fixed to a transmission shaft 20 which is axially slidable between two annular supports 22*a* and 22*b*.

Figure 1A:
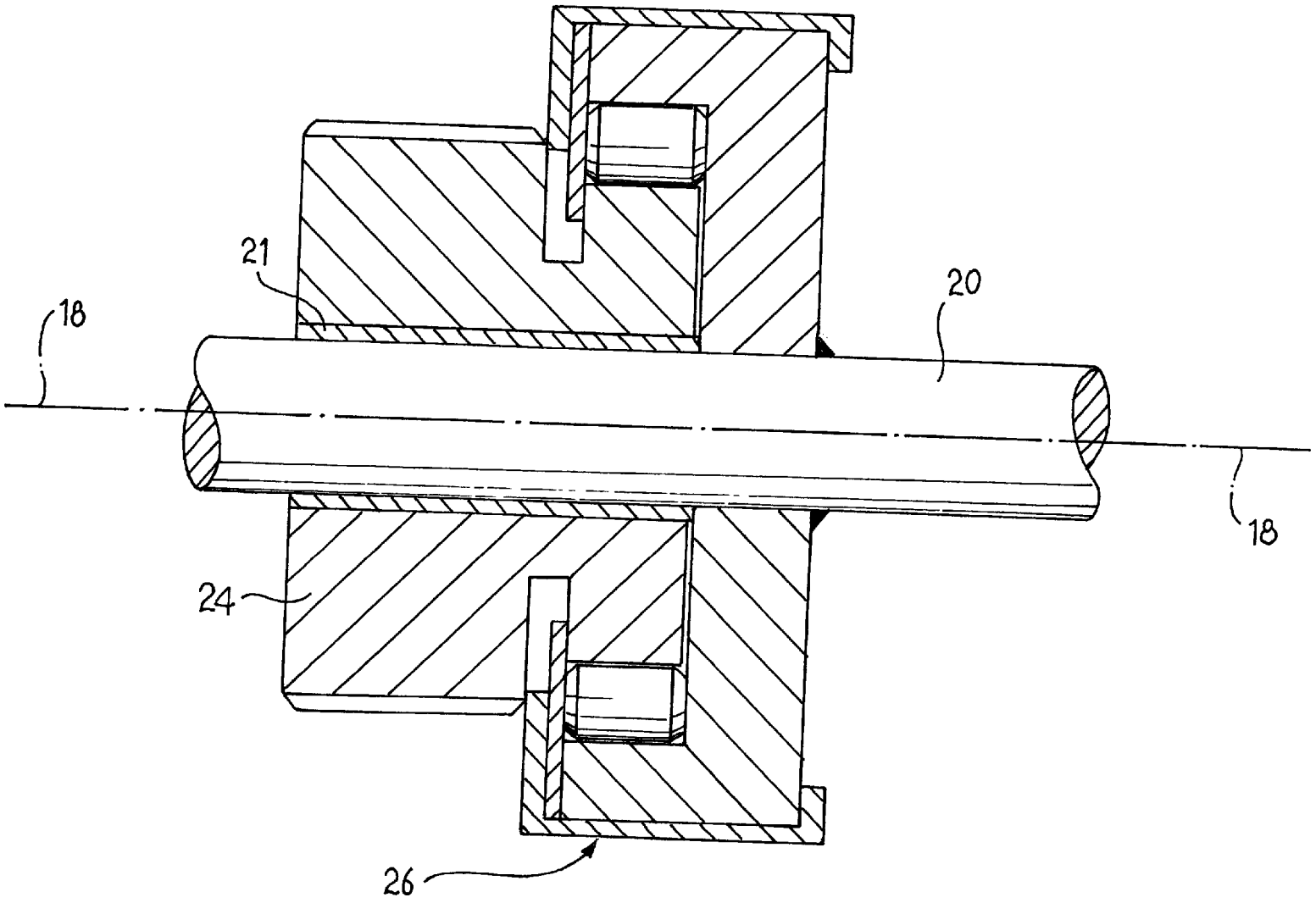
FIG. 1*a* is a view in partial section taken on the line Ia—Ia of FIG. 1.

As can be seen in FIG. 1*a,* a rotatable bush 21, to which is fixed a pinion 24, is fitted about the shaft 20. The shaft 20 and the pinion 24 are coupled together by means of an overrun clutch 26, commonly known as a free wheel, such that rotation of the transmission shaft 20 in the intended direction causes the pinion 24 to rotate although, vice versa, the pinion 24 is unable to cause the shaft 20 or, consequently, the electric machine 12 to rotate.

A shoulder 28 is also formed on the aforesaid shaft, which shoulder, in the embodiment shown, is located at the end of the shaft associated with the commutator 14 of the electric machine.

This shoulder 28 is disposed so to enable the alignment of the rotor 12*r* at the end of its stroke in the working position (see FIG. 2) and can, for example, be formed with a resilient stop ring of the Seeger type.

A biasing spring 30 is also provided, acting to hold the rotor 12*r* in the rest position of FIG. 1 and capable of being compressed during the advancement of the rotor 12*r* towards the working position of FIG. 2.

The starting device 10 is mounted so that the pinion 24 is located in correspondence with a toothed ring 34, fixed to the engine and usually formed on the fly-wheel thereof. The starting device can also include a partially open, conical cowling 33 to surround and protect the pinion-ring gear engagement, as shown in the drawings.

Figure 3:
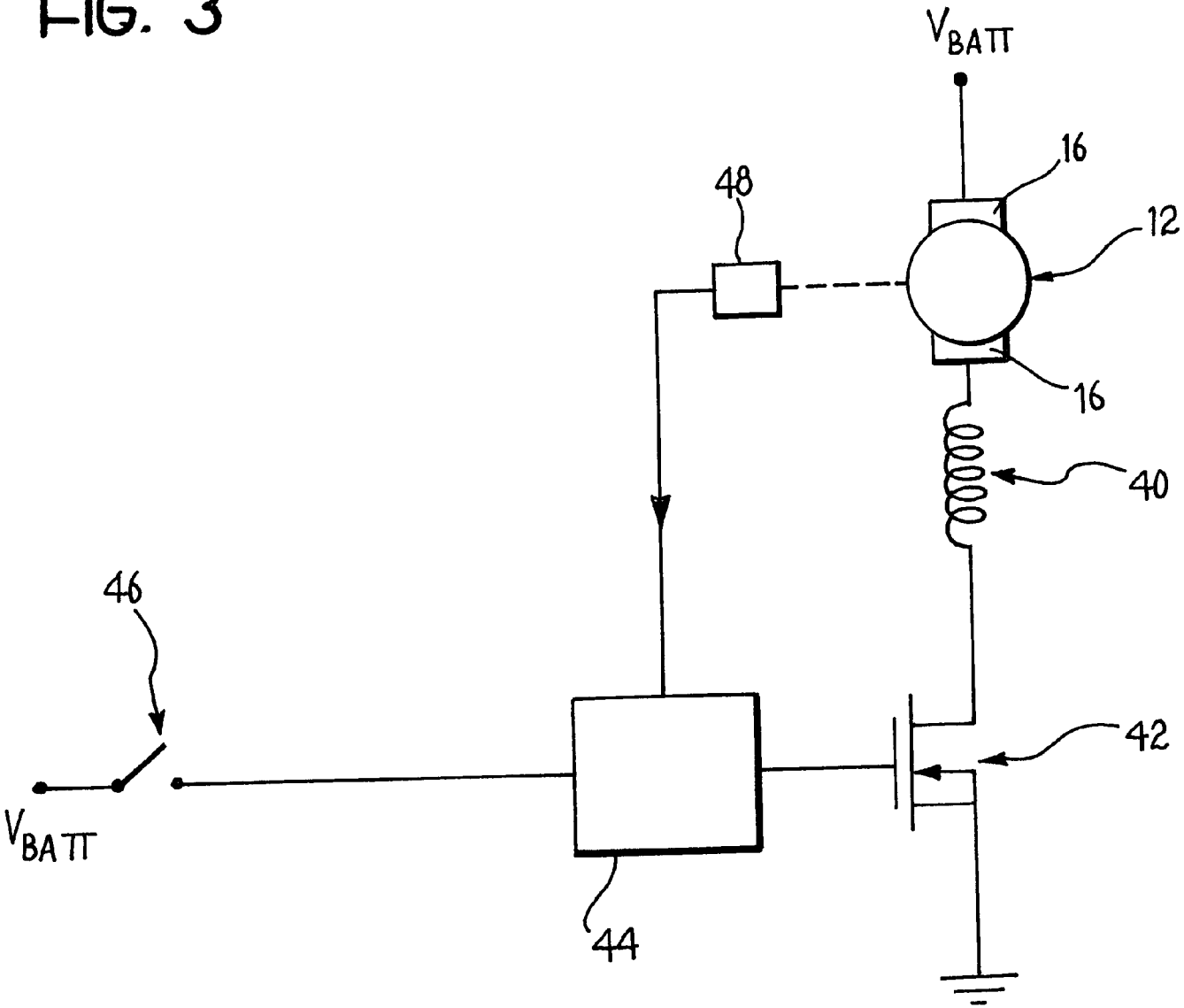
FIG. 3 is an electrical circuit diagram of the device according to the invention.

FIG. 3 illustrates schematically, purely by way of non-limitative example, an electrical circuit of the device of the invention.

The electric current supplied to the electric machine 12 by an accumulator battery flows through the stator field winding 40 and, in series, also supplies the rotor winding through the brushes 16. An electronic power device 42, for example, a MOSFET power transistor, is also disposed in series in the supply network.

An electronic control circuit 44 receives a starting command through the switch 46, and has its output coupled to the control input of the MOSFET 42.

A sensor 48 such as, for example, a position sensor, for detecting the operating position of the rotor along the longitudinal axis 18 is also preferably associated with the electric machine 12. This sensor, formed according to known criteria, has its output coupled to an input of the control circuit 44 in a general feedback connection scheme.

According to a preferred embodiment, the assembly of the electronic components (the MOSFET power transistor 42, the control circuit 44 and possible sensor 48), not shown in FIGS. 1 and 2, can easily be disposed on the starter device, close to the end carrying the commutator 14, thus maintaining the axial symmetry of the device itself and simplifying the connections between the electronic components and the electric machine 12.

In this case the sensor 48, if present, can advantageously be disposed in correspondence with the transmission shaft 20 in order to detect the position of the shaft 20 itself and, therefore, the operating position of the rotor.

The starter device is activated by closing the switch 46. The rotor 12*r* of the electric machine is initially in the rest position described in FIG. 1.

In a first operating phase, the control circuit 44 makes the MOSFET transistor 42 to be conductive by applying a voltage to the control input just sufficient to create a conduction channel between drain and source. In this way, the transistor 42 has a high resistance to conduction and limits the electrical supply current to the electric machine 12.

This current flows through the windings of the stator and the rotor, generating a magnetic flux. The particular shape of the rotor 12*r* and the stator 12*s* determine the attraction of the rotor to which the transmission shaft 20 and, by means of the free wheel 26, the pinion 24 are connected. The rotor 12*r* moves axially towards the working position, at the same time rotating slowly and thus assisting in the engagement of the pinion with the ring, even in those cases in which an obstacle will initially be created due to the unfavourable alignment of the teeth of the engagement mechanism.

When the rotor reaches the end of its stroke, determined by the abutment of the shoulder 28 against a corresponding abutment surface formed, for example, about the sliding seat 22*b*, the pinion 24 is completely engaged on the ring 34 and the first, or engagement, phase (see FIG. 2) ends.

The advancement of the rotor can be controlled by the sensor 48, when present, and the circuit 44 controls the transition to the second phase as a function of a feedback signal provided by the sensor. In the absence of the sensor 48, the transition to the second phase can be determined automatically by the same circuit 44 after a predetermined time interval, for example, 100 ms, sufficient to ensure the complete engagement of the pinion with the ring.

During the second operating phase, the circuit 44 applies sufficient voltage to the control input of the MOSFET transistor 42 for it to reach saturation point. The transistor 42 thus has a reduced resistance to the flow of supply current, and this increased current enables the electric machine 12 to rotate at full torque and rotate the internal combustion engine.

Once the internal combustion engine has been started, the free wheel 26 intervenes to uncouple the pinion 24 from the transmission shaft 20, which pinion is still engaged on the ring 34 and rotated thereby for a short period of time.

When the power supply to the entire device runs out, that is, when the switch 46 is opened, the control circuit 44 provides no further voltage to the control input of the MOSFET 42, and this latter is cut off, thus behaving substantially like an open switch.

In the absence of an electrical supply to the windings of the machine, the magnetic attraction of the rotor 12*r* disappears and this latter, as the result of the force of the biasing spring 30, moves away from the stator, disengaging the pinion 24 from the ring 34.

The entire device returns to the rest position and is prepared for re-activation in the manner described.

What is claimed is:

1. A starting device for an internal combustion engine comprising:

a transmission shaft bearing a first toothed member capable of coupling with a corresponding second toothed member of the internal combustion engine;

a rotating electric machine including a stator provided with a winding and a rotor which is fixed to the said shaft and axially translatable therewith with respect to the stator between a rest position and a working position in which the said first toothed member is capable of engaging with the toothed member of the engine; the machine being formed such that, each time it is activated, the rotor and the shaft are magnetically attracted towards the working position; and means for controlling the intensity of the current supplied to the electrical machine, wherein the stator of the electric machine includes a single winding, and the said means for controlling the current supplied to the machine include a controlled-conduction semiconductor device disposed substantially in series with the said stator winding, and an electronic control circuit connected to a control input of the semiconductor device and capable of varying the current conduction in a predetermined way so as to supply the stator winding with a low intensity current during a first phase so as to cause a slow rotation and translation of the rotor and the aforesaid shaft towards the working position, and a higher intensity current during a second phase in order to cause the transfer of torque from the electric machine to the internal combustion engine.

2. A device according to claim 1, wherein the said electronic control circuit is arranged to control the semiconductor device so as to supply the stator winding with a low intensity current for a predetermined time period.

3. A device according to claim 1, said device including sensor means capable of providing signals from which the axial position of the rotor can be determined, the said sensor means being connected in feedback with the electronic control circuit which is arranged to supply the said higher intensity current when the rotor reaches a predetermined axial position.

4. A device according to claim 1, wherein the said transmission shaft and the said first tooth ed member are coupled together by means of an overrun clutch.

5. A device according to claim 1, said device including resilient means capable of returning the rotor of the electric machine to the rest position.

6. A device according to claim 1, said device including stop means intended to prevent the axial translation of the rotor and the transmission shaft continuing once a completely coupled condition of the said first and second toothed members has been reached.

7. A device according to claim 6, wherein the said stop means comprise a shoulder formed on the transmission shaft and intended to co-operate with a corresponding stationary abutment surface.

8. A device according to claim 1, wherein the stator and the rotor have substantially conical internal and external shapes respectively.

9. A device according to claim 1, wherein the said controlled-conduction semiconductor device is a field-effect transistor.

* * * * *